United States Patent [19]

Brooks et al.

[11] 4,337,987

[45] Jul. 6, 1982

[54] TRAPPED-KEY SECURITY UNIT

[75] Inventors: Stuart M. Brooks, 9522 Briar Glenn Way, Gaithersburg, Md. 20760; Martin R. Fagan, Potomac, Md.

[73] Assignee: Stuart M. Brooks, Gaithersburg, Md.

[21] Appl. No.: 185,751

[22] Filed: Sep. 10, 1980

[51] Int. Cl.[3] ..... E05B 11/00

[52] U.S. Cl. ..... 312/219; 70/389; 292/338; 292/251.5

[58] Field of Search ..... 312/219; 70/389, 363; 292/338, 251.5; 296/1 C

[56] References Cited

U.S. PATENT DOCUMENTS

| | | | |
|---|---|---|---|
| 2,475,226 | 7/1949 | Ellis | 292/251.5 |
| 2,559,579 | 7/1951 | Abrahamson | 312/219 |
| 2,743,149 | 4/1956 | Abrahamson et al. | 312/219 |
| 2,953,012 | 9/1960 | Davis | 70/389 |
| 3,418,833 | 12/1968 | Kerr | 70/389 |
| 3,509,748 | 5/1970 | Trainor | 70/363 |
| 4,186,977 | 2/1980 | Gilovich et al. | 312/219 |

*Primary Examiner*—Victor N. Sakran
*Attorney, Agent, or Firm*—Ira C. Edell

[57] ABSTRACT

A cabinet includes a locking mechanism which prevents removal of a key unless the cabinet door is properly closed and a prescribed item is properly positioned and stored within the cabinet. In a preferred embodiment, the cabinet door assembly includes a hinge which is slotted so as to accept a rotatable cam of the locking mechanism to prevent hinge movement in the locked position. The stored item has a magnet secured thereto which, when properly positioned in the cabinet, pulls a spring biased magnetized bar into a position wherein a slotted extension of the bar permits the cam to pass into the hinge slot. With the item improperly positioned or removed, the slotted bar extension prevents rotation of the lock by blocking passage of the cam into the hinge slot. The key and lock combination are standard items of the type which prevent key removal from the lock unless the lock is turned to the locked position.

12 Claims, 5 Drawing Figures

2
13
14
15
11
10

10
17
21
25
22
26
27
12
13
16
14

10
23
22
26
25
21
24
27
38
19
18
17
32
31
4
28
29
37
36
14
13
20
15
35
16
30
33
34

TRAPPED-KEY SECURITY UNIT

TECHNICAL FIELD

The present invention relates to security devices and, more particularly, to locking arrangements which permit detection of unauthorized removal of an item from a storage cabinet. Although the preferred embodiment is described herein in terms of storage of dealers' automobile license tags and detection of unauthorized removal of such tags, it is understood that the inventive concepts described herein have equal application to detecting unauthorized removal of other objects of widely differing configurations and uses.

BACKGROUND OF THE INVENTION

There is a common problem in automotive dealerships (i.e. automotive retail sales establishments) concerning mis-use of dealers' license tags or plates. Dealers' tags are intended primarily for use on demonstrator vehicles used by the dealership to provide test drives for prospective customers. All too often, however, dealers' tags are used by dealership salesmen for their personal vehicles or vehicles belonging to friends or family of the salesmen. The problem presented by this tag mis-use is two-fold. First, tags are often unavailble when needed for their intended use, namely to put onto a demonstrator vehicle for a customer test drive, and therefore a potential sale is very likely lost. Second, the dealership is subjected to a considerable potential liability, both civil (in the event an unauthorized vehicle is involved in an accident) and criminal (by virtue of violation of local statutes for mis-use of specially issued dealership tags). Superficially simple solutions, such as placing all dealership tags in charge of the sales manager, have proved to be impractical since it is likely that the sales manager may be with a customer and unavailable to break away to accommodate a salesman in need of a tag for a test drive.

SUMMARY OF THE INVENTION

It is therefore an object of the preent invention to provide a security arrangement which permits automotive dealership owners or managers to keep track of the whereabouts of all of its tags without requiring the owner or manager to personally distribute the tags when needed by dealership sales personnel. In a broader sense, it is an object of the present invention to provide a security arrangement which permits detection of unauthorized removal of a stored object from a cabinet and a determination of the perpetrator of such unauthorized removal.

In accordance with the present invention a cabinet is provided for storing a license tag in a prescribed position. The cabinet has a hinged door, the hinge being slotted to receive a cam of a lock assembly when the lock is rotated in the closed position. The lock assembly and its key are of the standard trapped-key type wherein key removal is prevented unless lock is in its locked position. The door hinge precludes rotation of the lock to its locked position unless the door is closed so that the cam is able to pass into the hinge slot. The cabinet and license tag are provided with co-operating elements which dispose a blocking member in the path of the cam to prevent the lock from rotating to its locked position unless the tag is properly positioned in the cabinet. When the tag is properly positioned a slot or channel in the blocking member is aligned with the cam to permit it to pass through the hinge slot. Any cooperating parts may be employed to position the blocking member as a function of proper positioning of the tag in the cabinet; however, in the preferred embodiment described herein, a magnet secured to the tag cooperates with a magnetized actuator bar positioned behind the rear magnetically-inert wall of the cabinet and is spring biased away from that wall. When the tag is properly positioned its magnet attracts the actuator bar toward the wall, in opposition to the spring bias. The blocking member is secured to or part of the actuator bar and is positioned relative to the locking cam to effect the described result. Keys to the cabinet are individually numbered and are assigned to dealership salesmen. The door of the cabinet is preferably transparent so that a manager can readily scan plural contiguous cabinets to determine which tags are removed. Since each empty cabinet will have a numbered trapped key, the salesman to whom the key is assigned is easily identified.

BRIEF DESCRIPTION OF THE DRAWINGS

The above and still further objects, features and advantages of the present invention will become apparent upon consideration of the following detailed description of one embodiment thereof, especially when taken in conjunction with the accompanying drawings, wherein.

DESCRIPTION OF THE PREFERRED EMBODIMENT

Figure 1:
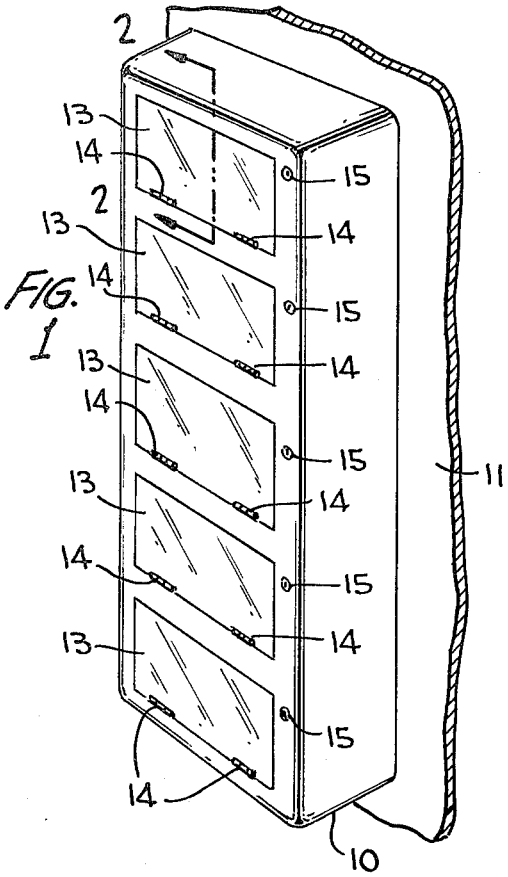
FIG. 1 is a view in perspective of an assembly of five locking cabinets constructed in accordance with the principles of the present invention.
Figure 2:
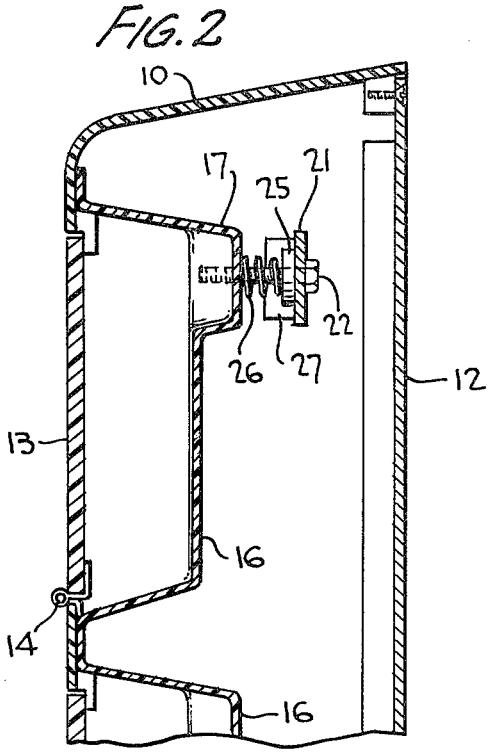
FIG. 2 is a view in section taken along lines 2—2 of FIG. 1.

Referring to the drawings in greater detail, an assembly 10 of five vertically aligned storage cabinets is secured to a support wall 11 along its rear wall 12 by any conventional means such as screws, bolts, hooks, etc. Each cabinet has a transparent door 13 which is hinged at 14 along its bottom edge to assembly 10 to permit the top edge of the door to swing down and away from the assembly. A separate lock assembly 15 is provided for each cabinet. For the license tag embodiment described herein, door 13 is preferably transparent and the locks 15 are the same for each cabinet; however, these features are not necessarily required for other applications of the invention.

The cabinets themselves are formed as a series of vertically-aligned box-like members 16 open on one side and secured inside assembly 10 to the front assembly wall such that the open side of each box 16 is aligned with and covered by a respective cabinet door 13. In the preferred embodiment, all of the box members 16 are formed as part of an integrally molded plastic unit which is secured to the front wall of assembly 10 by means of adhesive, screws, or the like, adjacent the periphery of each door 13. The rear of the strip of boxes 16 is spaced from the rear wall 12 of assembly 10.

A projection 17 extends from the rear of each box 16 toward rear assembly wall 12 to define a magnet-receiving recess inside the cabinet. In the preferred embodiment this recess 17 is in the form of a channel extending horizontally along a portion of the top of the rear wall of the box. Each of the side, top and bottom walls diverge slightly from the rear wall of box 16 which is parallel to the front wall of assembly 10.

Recess 17 is arranged to receive a ceramic bar magnet 18 (FIG. 3) which is secured by means of screws 19 or the like along the top of the rear surface of an automotive vehicle license tag 20. Such magnets 18 are conventionally secured to dealers' tags to facilitate use and removal of the tags in conjunction with different demonstrator vehicles. In this respect, the rear wall of each box 16 should be at least as large as the license tag 20 so that the tag can be positioned adjacent that wall when bar magnet 18 is received in recess 17.

An actuator bar 21 of magnetically permeable material is secured in a horizontally-extending position along the outer surface of the rear wall of each box 16. Specifically, actuator bar 21 is slidably supported on studs or bolts 22 extending through suitable clearance holes 23 at opposite ends of the bar. The studs are threadedly engaged by respective support blocks 24 secured to the rear wall of each box at opposite ends of recess 17. Each stud 22 extends through a respective washer 25 and bias spring 26, the latter serving to bias actuator bar 21 rearwardly (i.e. away from box 16). One or more magnets 27 are secured by adhesive or the like to actuator bar 21, preferably, although not necessarily, on the surface of bar 21 which faces box 16. The magnets 27 serve to magnetize actuator bar 21.

The end of actuator bar 21 which corresponds to the position of lock assembly 15 for the cabinet includes a blocking member 28 which may either be an integral part of the actuator bar or a separate piece secured thereto by means of screws or the like. Blocking member 28 is a bar-like member which extends forwardly and perpendicularly from actuator bar 21 along the side wall of box 16 toward the front wall of assembly 10. A recess 29 is defined transversely into blocking member 28 from its upper edge for purposes to be described hereinbelow.

A modified piano hinge 30 is secured at its forward end to the rear side of door 13 and is freely suspended at its rear end which is bent perpendicularly to provide a stop 31. Hinge 30 extends through a suitably provided slot 32 (FIG. 3) in the rear wall of box 16 so that, in the fully opened position of door 13 (FIG. 4), stop 31 supports the door by abutting the rear wall of the box 16. The hinge 30 is shown as a two piece folding arm type hinge which folds as necessary to accommodate itself to the space provided inside assembly 10 in the closed cabinet condition. It should be noted, however, that hinge 30 can likewise be a one piece member, depending upon the space provided. The forward end of hinge 30 is a vertically widened section 33 in which a longitudinally extending slot 34 is defined for purposes described hereinbelow.

Figure 3:
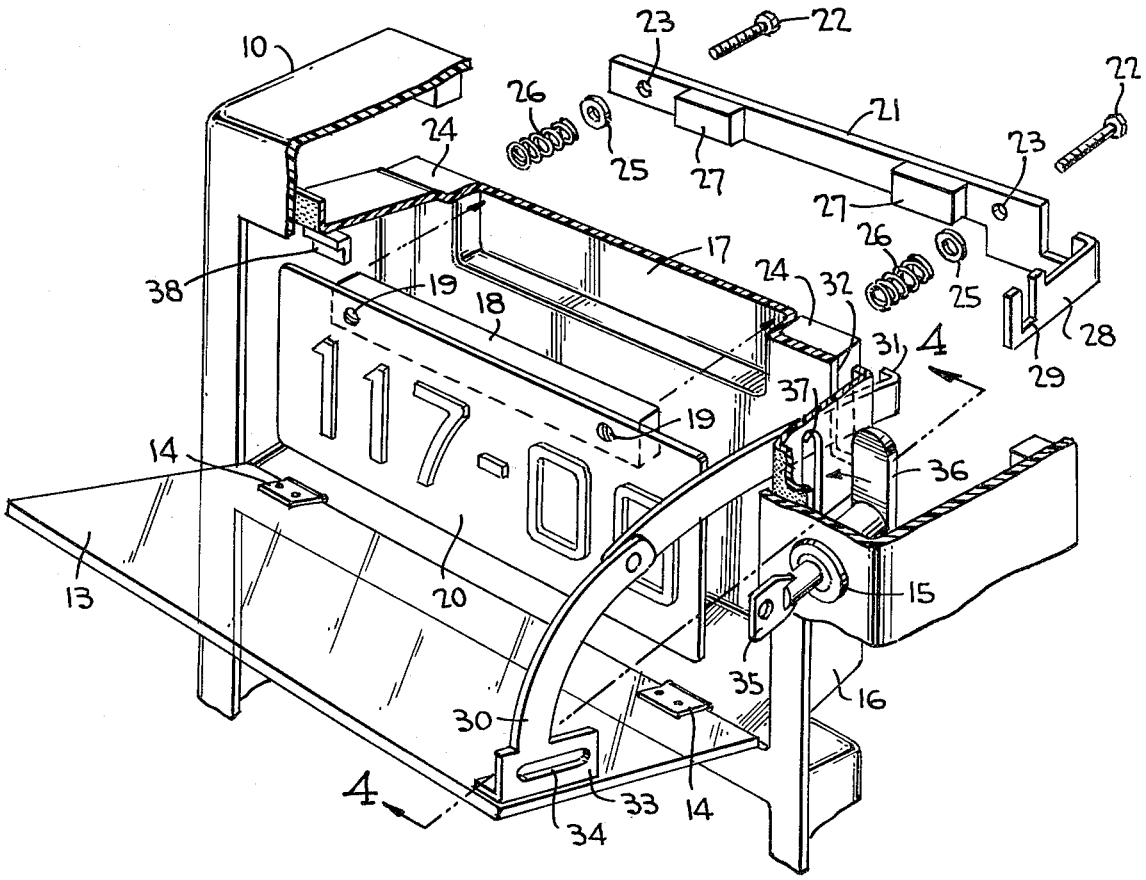
FIG. 3 is a perspective view, partially cut away and partially exploded, of one cabinet of the assembly of FIG. 1.

Lock assembly 15, which is secured in assembly 10 adjacent one side of each cabinet, is a conventional lock assembly of the type which traps or retains the key 35 in the lock unless the lock is in its locked position. Such lock assemblies are well and typical of those described in U.S. Pat. Nos. 3,418,833 and 3,509,748. As illustrated in FIG. 3, the lock assembly includes a shaft (not shown) to which a cam 36 is secured at the distal end and which is rotatable about its axis by a proper key to rotate the cam 36 accordingly. In the embodiment shown, the cam is rotatable through 90° from an open position, with cam 36 extending vertically, to a locked position, with cam 36 extending horizontally into box 16 through a suitably provided and aligned slot 37 in the box side wall.

Figure 4:
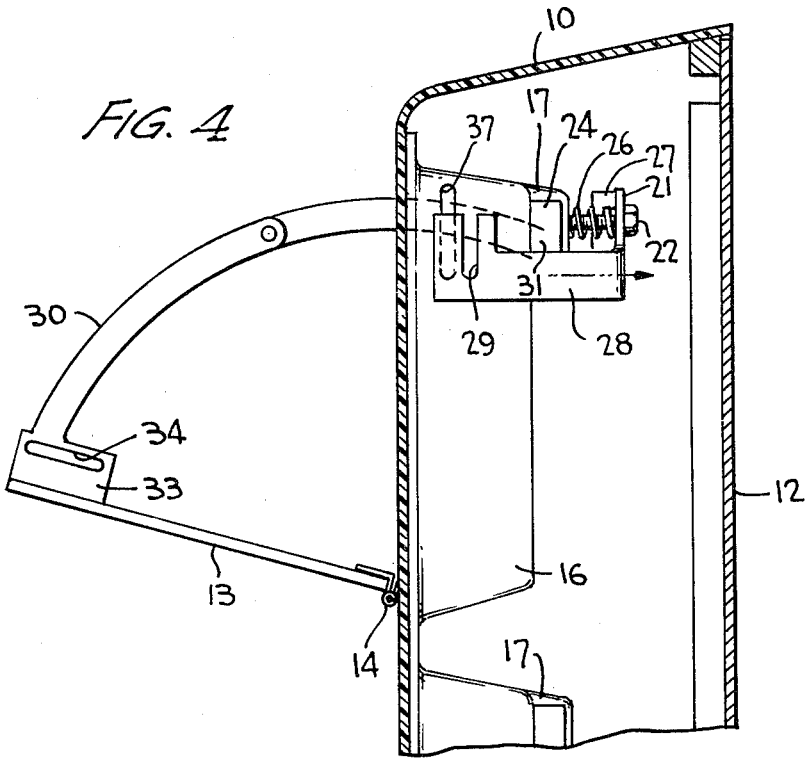
FIG. 4 is a view in section of the open cabinet taken along lines 4—4 of FIG. 3.

The closed position of door 13 is defined by a stop block 38 secured to and depending from the top wall of each box to permit door 13 to be positioned flush with the cut-out opening provided therefore in assembly 10. When door 13 is in its thusly determined closed position, slot 34 in enlarged portion 33 of hinge 30 is aligned with cam 36 and cam access slot 37 in box 16. When actuator bar 21 is pulled toward box 16 by bar magnet 18 properly positioned in recess 17, access recess 29 of blocking member 28 is aligned with cam 36 and cam access slot 37. Therefore, cam 36 cannot be rotated to the locked portion unless the door 13 is fully closed and license tag 20 is properly positioned in the cabinet with bar magnet 18 in recess 17. Specifically, as shown in FIG. 4, when door 13 is opened, slot 34 is not aligned with cam access slot 37; consequently the cam 36 (FIG. 3) is blocked by hinge 30 from rotating to the closed position. The key 35 cannot be removed from lock 15 under this condition. As also seen in FIG. 4, when actuator bar 21 is not attracted by the bar magnet 18 of tag 20, slot 29 is not aligned with cam access slot 37, so that cam 36 is not permitted to pass through the cam access slot to rotate to the closed position. For this condition, too, the key 35 is prevented from being removed from lock 15.

Figure 5:
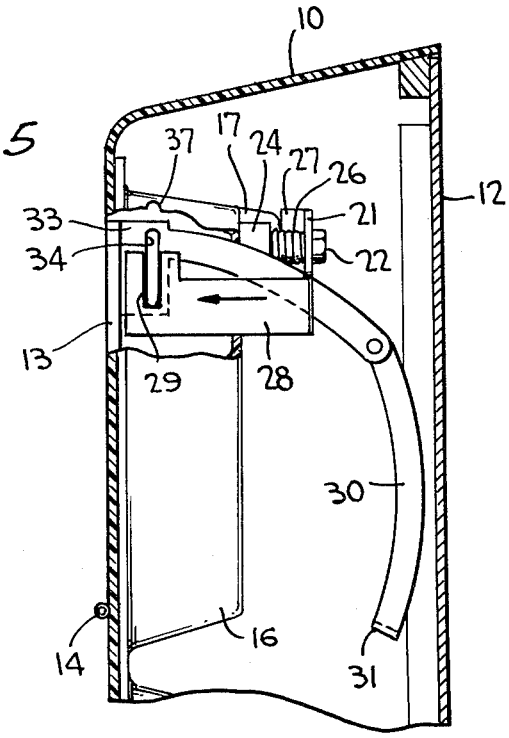
FIG. 5 is a view in section similar to that of FIG. 4 but showing the cabinet in its locked condition.

From the above it will be appreciated that the key 35 cannot be removed from lock 15 if door 13 is not fully closed, or if tag 20 is not properly positioned in the cabinet, or if both of these conditions exist. On the other hand, as best illustrated in FIG. 5, if door 13 is fully closed and actuator bar 21 is attracted toward the box, then slots 29 and 34 are aligned with cam access slot 37 to permit full rotation of the cam to the locked position. Under this condition the key 35 may be removed from the lock.

It will be appreciated that actuator bar need not be magnetically actuated but instead can be actuated by suitably keyed projections extending from the rear of tag 20 (or other objects to be protected) through suitable apertures in the box to move the actuator bar. Likewise, the actuator can be biased toward the box rather than away from it so long as the slot 29 is positioned accordingly.

For the dealers' tag applications described, each key is individually numbered and fits each lock assembly. Each dealership salesman is assigned a numbered key so that the manager can readily determine who removed a particular license tag. The tag number may be written on the rear wall, or on a sheet affixed to the rear wall, of each cabinet so that the manager can determine the number of the missing tag. The transparent door can be made of any transparent material but is preferably made of an impact resistant material such as LEXAN or similarly strong plastic.

While we have described an illustrated one embodiment of our invention, it will be clear that variations of the details of construction which are specifically illustrated and described may be resorted to without departing from the true spirit and scope of the invention as defined in the appended claims.

We claim:

1. In a cabinet for storing a predetermined article, a security locking arrangement comprising:

key and lock assembly means comprising a key and a lock having a cam which is rotatable with said key through a prescribed angle between unlocked and locked positions, said key being insertable into said lock, said lock including means for preventing removal of said key therefrom except when said cam is in said locked position;

a cabinet door assembly for said cabinet capable of moving between open and closed positions and including closure means for preventing rotation of said cam to said locked position unless said door assembly is in said closed position; and actuable means responsive to the presence of said article in said cabinet for permitting rotation of said cam to said locked position and for preventing cam rotation to said locked position when said article is absent from said cabinet.

2. The locking arrangement according to claim 1 wherein said closure means comprises a hinge member movable with said door assembly along a path which blocks said cam from rotation to said locked position, said hinge having slot defined therein which is aligned with said cam when said door assembly is in said closed position to permit said cam to be rotated to said locked position.

3. The locking arrangement according to claim 2 wherein said cabinet is in the form of a box closed on all but its front side, wherein said door assembly is pivotable about an axis disposed along said front side between said open and closed positions, wherein said hinge is movable in a plane perpendicular to said axis, and wherein said cam is rotatable in a plane perpendicular to the plane of movement of said hinge.

4. The locking arrangement according to claim 3 wherein said axis is horizontal, wherein the plane of movement of said hinge is vertical and perpendicular to the front side of said box, and wherein the plane of rotation of said cam is vertical and parallel to the front side of said box.

5. The locking arrangement according to claims 1, 2, 3 or 4 wherein said actuable means comprises:

receiving means in said box for receiving said article in a predetermined position;

a blocking member movable between first and second positions in the path of rotation of said cam and having an opening defined therein which, in said first position of said blocking member, permits rotation of said cam to said locked position, said blocking member otherwise preventing rotation of said cam to said locked position;

bias means for normally urging said blocking member to said second position; and operating means responsive to said article being in said predetermined position in said receiving means for moving said blocking member to said first position.

6. The locking arrangement according to claim 5 wherein said operating means comprises a magnet secured to said article and a magnetically permeable member secured to said box proximate said receiving means, wherein said bias means comprises spring means for urging said magnetically permeable member away from said receiving means, wherein the presence of said magnet in said receiving means attracts the magnetically permeable member to the magnet against the bias of said spring means, and wherein said blocking member is an extension of said magnetically permeable member.

7. The locking arrangement according to claim 5 wherein said operating means is magnetic.

8. The locking arrangement according to claim 6 wherein said magnetically permeable member moves in a horizontal plane between said first and second positions, and wherein said blocking member extends perpendicularly from said magnetically permeable member.

9. The locking arrangement to claim 1 further comprising stop means for defining said closed position of said door assembly.

10. The locking arrangement according to claim 1 wherein said cabinet is part of a multi-cabinet assembly in which five sides of each cabinet in the assembly are part of an integrally molded plastic member.

11. The locking assembly according to claim 10 wherein the locks for each of said cabinets are operable by the same key and wherein a plurality of such keys are provided, each key being individually numbered.

12. The locking arrangement according to claim 1 wherein said door assembly includes a transparent portion to permit viewing of the inside of the cabinet.

* * * * *